United States Patent [19]

Tanigawa et al.

[11] Patent Number: 4,865,553

[45] Date of Patent: Sep. 12, 1989

[54] HINGED CONNECTOR

[75] Inventors: Junichi Tanigawa, Kawasaki; Shoji Kikuchi, Hiratsuka, both of Japan

[73] Assignee: AMP Incorporated, Harrisburg, Pa.

[21] Appl. No.: 310,793

[22] Filed: Feb. 14, 1989

[30] Foreign Application Priority Data

Mar. 31, 1988 [JP] Japan ..... 63-44167[U]

[51] Int. Cl.[4] ..... H01R 39/00

[52] U.S. Cl. ..... 439/31; 439/13

[58] Field of Search ..... 439/13, 18, 31, 660

[56] References Cited

U.S. PATENT DOCUMENTS

| | | | |
|---|---|---|---|
| 3,268,849 | 8/1966 | Silverberg | 439/660 |
| 3,601,746 | 8/1971 | Teagno . | |
| 3,960,434 | 6/1976 | Soes | 439/660 |
| 4,341,430 | 7/1982 | Crawford . | |
| 4,632,475 | 12/1986 | Tomita . | |
| 4,657,320 | 4/1987 | Bamford et al. . | |
| 4,715,819 | 12/1987 | Iwasa et al. | 439/31 |

FOREIGN PATENT DOCUMENTS

| | | | |
|---|---|---|---|
| 251515 | 1/1988 | European Pat. Off. | 439/31 |
| 921869 | 5/1947 | France | 439/660 |
| 1110270 | 2/1956 | France | 439/660 |

*Primary Examiner*—Gary F. Paumen

*Attorney, Agent, or Firm*—Adrian J. LaRue; Bruce J. Wolstoncroft

[57] ABSTRACT

A hinged electrical connector comprises a receptacle connector (RC) and a tab connector (TC) that are hingedly connected together by hinge members (3, 4, 5a, 6), the connectors having coplanar receptacle contact sections (12) of receptacle contacts (7) electrically engaged with tab contact sections (14) of tab contacts (8) and conductor-engaging sections (9,10) electrically engaged with conductive areas of circuit boards (11a, 11b) enabling the boards to be moved between angular positions and maintained thereat.

8 Claims, 3 Drawing Sheets

HINGED CONNECTOR

FIELD OF THE INVENTION

This invention relates to an electrical connector used in various electronic equipment. More particularly, the invention is directed to an electrical connector for electrically connecting electronic circuits on two circuit boards and enabling the circuit boards to be moved relative to each other and being maintained at a prescribed angle.

BACKGROUND OF THE INVENTION

In recent years, great progress has been made in producing smaller and smaller electronic products, especially consumer products. This has created a demand for circuit boards with more electronic components mounted thereon. Hinged connectors of the type disclosed in U. S. Pat. Nos. 4,632,475; 4,657,320 and Japanese Appln. No. 63-12425 filed Jan. 22, 1988 have not been able to satisfy the high-density requirements of components on the circuit boards because they are bulky, the spacing between the contacts is large due to the size of the contacts and the contacts are expensive to make.

SUMMARY OF THE INVENTION

The objective of the present invention is to take into consideration the above situation and to provide a receptacle connector and a tab connector electrically and hingedly connected together which are electrically connectable to respective circuit boards thereby enabling the circuit boards to be angularly moved relative to one another and maintained at a prescribed angle, the spacing between the electrical contacts is very close and the contacts are not expensive to make.

According to the present invention, a hinged electrical connector comprises a receptacle connector and a tab connector, the receptacle connector including a dielectric housing having receptacle contacts secured therein which have receptacle contact sections positioned within the housing at closely-spaced intervals and conductor-engaging sections extending outwardly from the receptacle connector housing for electrical engagement with conductive members of a circuit board, the tab connector including a dielectric housing having tab contacts secured therein which have tab contact sections extending outwardly from a surface of the tab connector housing at the same closely-spaced intervals of the receptacle contact sections and electrically engaged with the respective receptacle contact sections and conductor-engaging sections extending outwardly from the tab connector housing for electrical engagement with conductive members of another circuit board, the tab contact sections and the receptacle contact sections being movable relative to one another during their electrical engagement, and hinge members provided by the tab connector housing and the receptacle connector housing enabling the tab connector and the receptacle connector and the circuit boards to which they are electrically connected to move relative to each other between angular positions and to be maintained at a prescribed angle.

The receptacle contacts have fork-shaped or U-shaped receptacle contact sections and the tab contact members have disc-shaped tab contact sections electrically and movably engaged with the fork-shaped receptacle contact sections so that they are in the same plane or coplanar.

BRIEF DESCRIPTION OF THE DRAWINGS

The invention will now be described by way of example with reference to the following detailed description of the invention in conjunction with the accompanying drawings.

DETAILED DESCRIPTION OF THE INVENTION

Figure 1:
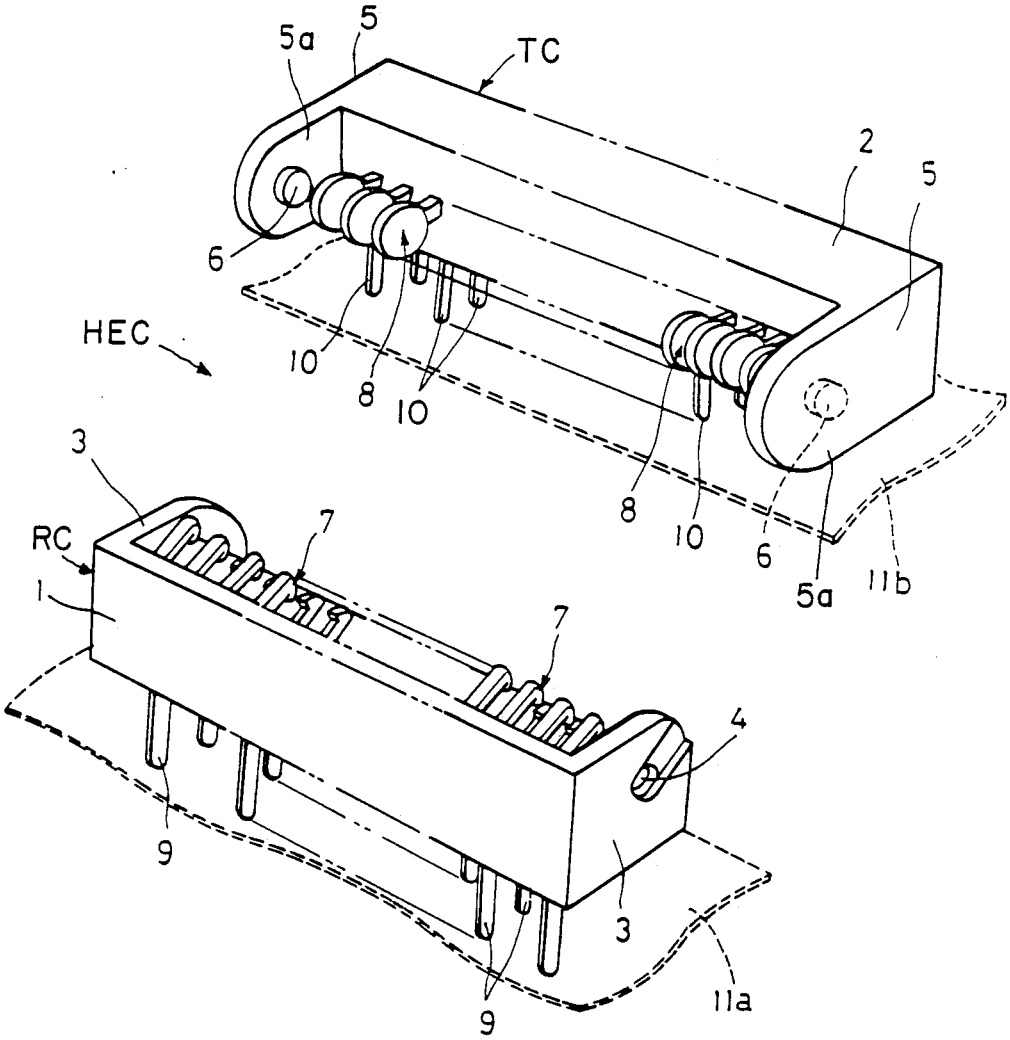
FIG. 1 is a perspective exploded view of the hinged electrical connector showing the receptacle connector and tab connector spaced from each other prior to being hingedly and electrically connected to each other.
Figure 2:
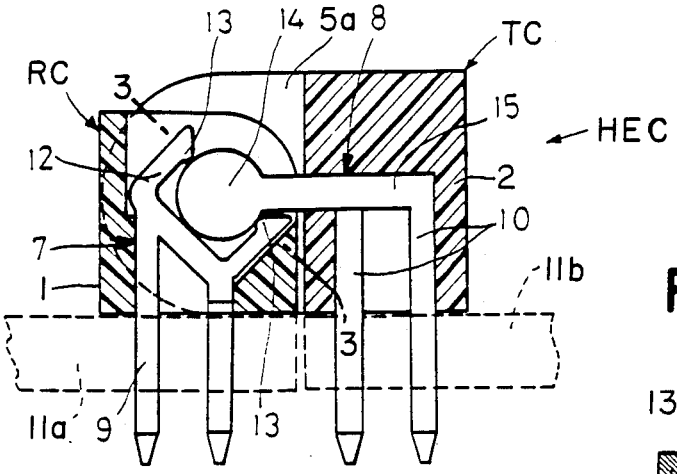
FIG. 2 is a cross-sectional view of the connector of FIG. 1 showing the tab connector and receptacle connector hingedly and electrically connected together with the circuit boards coplanar.
Figure 3:
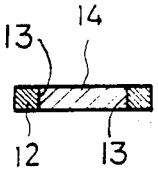
FIG. 3 is a view taken along line 3—3 of FIG. 2.

A hinged electrical connector HEC is shown in FIGS. 1–3 and includes a receptacle connector RC and a tab connector TC. Receptacle connector RC includes a dielectric housing 1 having recesses 4 in the outside surfaces of side walls 3. Sidewalls 5 of dielectric housing 2 of tab connector TC include extensions **5*a* that have inwardly-directed annular projections 6 that serve as shafts which are positioned into recesses 4 of sidewalls 3 of receptacle connector housing 1 thereby hingedly connecting receptacle connector housing 1 and tab connector housing 2** together so that they can move about 90 degrees relative to one another.

Receptacle contacts 7 are secured in position in housing 1 at closely-spaced intervals and each receptacle contact 7 includes a U-shaped or fork-shaped receptacle contact section 12 positioned within a space within housing 1 and a post contact or conductor-engaging section 9 extending outwardly from a bottom surface of housing 1 for electrical engagement with respective conductive members of a circuit board **11*a*. As can be discerned from FIG. 2, receptacle contact sections 12 are disposed at about 45 degrees with respect to the bottom surface of housing 1. Every alternative receptacle contact 7 has post contact section 9 extending from an upper end of the receptacle contact sections 12 while the other alternative receptacle contacts have post contact sections 9 extending from a lower end of the receptacle contact sections 12 thereby resulting in staggered positions of post contacts sections 9 along two parallel rows as they extend from the bottom surface of housing 1 as shown in FIG. 1. Receptacle contact sections 12 have inwardly-protruding contacts 13 adjacent the free ends of the legs of the U-shaped receptacle contact sections 12**.

Tab contacts 8 are secured in housing 2 at closely-spaced intervals corresponding to that of receptacle contacts 7 in housing 1 and each tab contact 8 includes a disc-shaped tab contact section 14 at the outer end of an arm 15 that extends outwardly from a front surface of housing 2, and a post contact or conductor-engaging section 10 that extends outwardly from a bottom surface of housing 2 for electrical engagement with conductive areas of circuit board 11*b*. Every alternative arm 15 is long while the other alternative arms 15 are short so that post contact sections 10 are staggeredly disposed in two parallel rows as shown in FIG. 1.

As shown in FIG. 2, disc-shaped tab contact sections 14 are disposed within respective U-shaped receptacle contact sections 12 so as move therein with contacts 13 electrically engaging the peripheral edges of the tab contact sections 14. This results in extremely low contact resistance and the receptacle contact sections 12 and tab contact sections 14 can move smoothly and easily relative to each other when the receptacle connector and tab connector are angularly moved relative to one another. Moreover, as shown in FIG. 3, the receptacle contacts 7 and tab contacts 8 are coplanar with a thickness of a single contact which enables more contacts to be located in housings 1 and 2 thereby resulting in higher density to accommodate the increased number of components on circuit boards 11*a*, 11*b* and the hinged electrical connector permits the boards to be angularly positioned relative to one another and maintained at a prescribed angular disposition between about zero degrees and about 90 degrees.

Contacts 7 and 8 are stamped from a suitable metal without any forming operations so that they are inexpensive to make due to the simplified tooling to make them.

Figure 4:
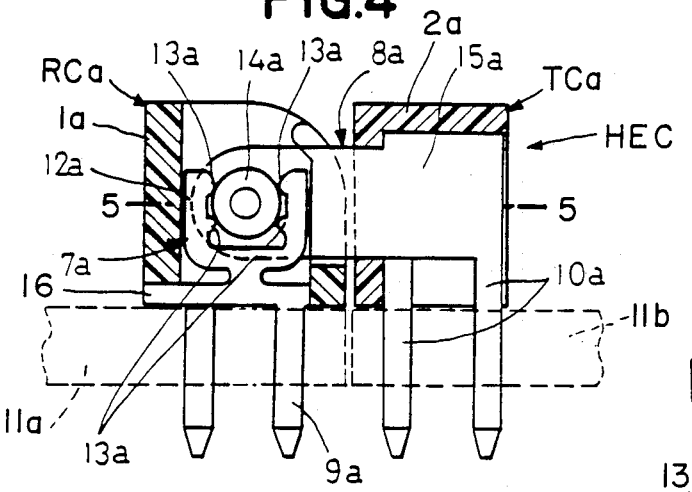
FIG. 4 is a cross-sectional view like FIG. 2 of an alternative embodiment of the connector.
Figure 5:
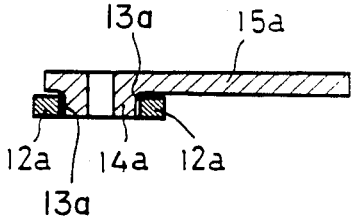
FIG. 5 is a view taken along line 5—5 of FIG. 4.

Hinged electrical connector HECa is shown in FIGS. 4 and 5 and is an alternative embodiment of the connector. U-shaped receptacle contact sections 12*a* of receptacle contacts 7*a* are secured within housing 1*a* and they are each connected to an arm 16 by a necked-down section. Arms 16 extend along a bottom surface of housing 1*a* with post sections 9*a* extending downwardly from respective arms 16 and housing 1*a* in a staggered manner so as to be in two parallel rows as shown in FIG. 2 for electrical engagement with conductive areas of board 11*a*. Thus, receptacle contact sections 12*a* within housing 1*a* are normally positioned with respect to arms 16 and the bottom surface of housing 1*a*. The legs of receptacle contact sections 12*a* have opposed inwardly-directed contacts 13*a*.

Disc-shaped tab contact sections 14*a* extend outwardly from the sides of arms 15*a* of tab contacts 8*a* and are electrically engaged within respective receptacle contact sections 12*a* as shown in FIGS. 4 and 5. Contacts 13*a* of receptacle contact sections 12*a* electrically engage the peripheral edges of tab contact sections 14*a* with low resistance and receptacle contact sections 12*a* and tab contact sections 14*a* smoothly move relative to one another between about zero degrees and about 90 degrees. Post contact sections 10*a* extend outwardly from arms 15*a* and from the bottom of housing 2*a* in a staggered manner so as to be located in two parallel rows for electrical engagement with conductive areas of board 11*b* as shown in FIG. 4.

Receptacle contacts 7*a* are stamped from a metal strip and tab contacts 8*a* are stamped from a premilled metal strip so as to form disc-shaped tab contact sections 14*a*. The double thickness of metal of receptacle contacts 7*a* and tab contacts 8*a* is still one metal thickness less that the three metal thicknesses of the contacts of the prior art hinged electrical connectors and can therefore enable the contacts to be more closely spaced together than the contacts of such prior art hinged connectors.

Figure 6:
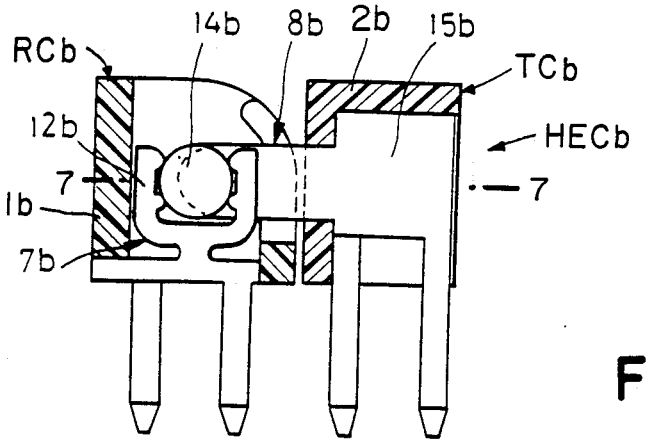
FIG. 6 is a cross-sectional view like FIGS. 2 and 4 of a further embodiment of the connector.
Figure 7:
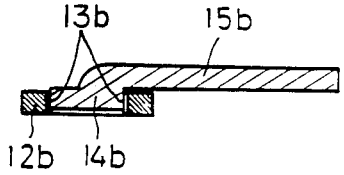
FIG. 7 is a view taken along line 7—7 of FIG. 6.

The further embodiment of the hinged electrical connector HECb of FIGS. 6 and 7 is substantially the same as that of FIGS. 4 and 5 except that disc-shaped tab contact sections 14*b* are formed from arms 15*b* so that premilled metal strip is not used. Moreover, arm 15*b* is more narrow than arm 15*a* and an outer part of tab contact section 15*b* extends beyond the outer end of arm 15*b*. Otherwise, the connectors of FIGS. 4, 5 and 6, 7 are the same and operate the same.

A hinged electrical connector has been described which, in one embodiment, has electrically engaged U-shaped receptacle contact sections and disc-shaped receptacle contact sections that are coplanar and of a single metal thickness; and which, in alternative embodiments, the receptacle contact sections and tab contact sections are two metal thickness. The contacts of the connector are closely spaced resulting in an increased number of contacts to electrically interconnect circuit boards that are hingedly connected by the hinged electrical connector. The electrical engagement between the U-shaped receptacle contact sections and the disc-shaped tab contact sections is low resistance and they are easily and smoothly moved relative to each other between angular positions at which the circuit boards to which they are electrically connected can be maintained.

We claim:

1. An electrical connector for interconnecting the conductive areas of circuit boards and enabling the circuit boards to be moved between angular positions and maintained thereat, comprising:

a receptacle connector including a dielectric receptacle housing and receptacle contacts secured in said receptacle housing, said receptacle contacts having receptacle contact sections disposed in said receptacle housing and conductor-engaging sections extending outwardly from said receptacle housing for electrical engagement with the conductive areas of a first circuit board;

a tab connector including a dielectric tab housing and tab contacts secured in said tab housing, said tab contacts having arms disposed in said tab housing and conductor-engaging sections 10 extending outwardly from said tab housing for electrical engagement with conductive areas of a second circuit board, and tab contact sections on said arms and positioned outwardly from said tab housing and electrically engaged with respective said receptacle contact sections, the tab contact sections and receptacle contact sections being coplanar and being movable relative to each other between angular positions, said tab contact sections being received in said receptable contact sections; and hinge members of said receptacle housing and said tab housing hingedly connecting said receptacle connector and said tab connector together enabling them to angularly move between the angular positions and be maintained thereat.

2. An electrical connector as claimed in claim 1, wherein the receptacle contact sections are U-shaped.

3. An electrical connector as claimed in claim 2, wherein the receptacle contact sections are disposed in said receptacle housing at a position of forty five degrees with respect to the bottom surface of said receptacle housing.

4. An electrical connector as claimed in claim 2, wherein the receptacle contact sections are disposed in said receptacle housing at a right angle with respect to the bottom surface of said receptacle housing.

5. An electrical connector as claimed in claim 2, wherein the legs of the U-shaped receptacle contact sections have inwardly-directed contacts.

6. An electrical connector as claimed in claim 1, wherein said tab contact sections are disc-shaped and located at the outer ends of said arms.

7. An electrical connector as claimed in claim 1, wherein said tab contact sections are disc-shaped and located adjacent the outer ends of said arms and extend outwardly from the sides of said arms so that said arms and said tab contact sections define two metal thicknesses.

8. An electrical connector as claimed in claim 1, wherein said tab contact sections are disc-shaped and located at the outer ends of said arms with outer parts of said disc-shaped tab contact sections extending beyond the outer ends of said arms while inner parts of said disc-shaped con-act sections extend outwardly from sides of said arms and said tab contact sections define two metal thicknesses.

* * * * *

UNITED STATES PATENT OFFICE

CERTIFICATE OF CORRECTION

Patent No. 4,865,553 Dated September 12, 1989

Inventor(s) Junichi Tanigawa, Shoji Kikuchi

It is certified that error appears in the above-identified patent and that said Letters Patent is hereby corrected as shown below:

In the Claims:

Column 6, Claim 8, Line 8 - add "tab" after the word "disc-shaped" and the word "con-act" should be --contact--.

Signed and Sealed this

Second Day of April, 1991

*Attest:*

*Attesting Officer*

HARRY F. MANBECK, JR.

*Commissioner of Patents and Trademarks*